US005645474A

United States Patent [19]

Kubo et al.

[11] Patent Number: 5,645,474

[45] Date of Patent: Jul. 8, 1997

[54] WORKPIECE RETAINING DEVICE AND METHOD FOR PRODUCING THE SAME

[75] Inventors: Naoto Kubo; Yoshitane Shigeta; Hideyuki Ishii, all of Yamatokoriyama, Japan

[73] Assignee: Rodel Nitta Company, Japan

[21] Appl. No.: 632,675

[22] Filed: Apr. 16, 1996

[30] Foreign Application Priority Data

Nov. 30, 1995 [JP] Japan ..... 7-313380

[51] Int. Cl.[6] ..... B24B 5/00

[52] U.S. Cl. ..... 451/287; 451/388; 451/41; 451/288; 451/289

[58] Field of Search ..... 451/385, 388, 451/390, 289, 398, 288, 287; 156/345

[56] References Cited

U.S. PATENT DOCUMENTS

| | | | |
|---|---|---|---|
| 4,519,168 | 5/1985 | Cesna | 451/287 |
| 4,521,995 | 6/1985 | Sekiya | 451/388 |
| 4,597,228 | 7/1986 | Koyama et al. | 451/388 |
| 5,205,082 | 4/1993 | Shendon et al. | 451/398 |
| 5,267,418 | 12/1993 | Currie et al. | 451/398 |
| 5,423,716 | 6/1995 | Strasbaugh | 451/388 |
| 5,443,416 | 8/1995 | Volodarsky et al. | 451/388 |

FOREIGN PATENT DOCUMENTS

| | | | |
|---|---|---|---|
| 362024962 | 2/1987 | Japan | 451/288 |
| 362264864 | 11/1987 | Japan | 451/288 |

*Primary Examiner*—Robert A. Rose
*Assistant Examiner*—George Nguyen
*Attorney, Agent, or Firm*—Snell & Wilmer

[57] ABSTRACT

A retaining device retains a workpiece to allow the workpiece to slide against a polishing pad located on a polishing board opposed to the retaining device. The retaining device includes a plate including a permeable portion and a seal portion having a lower permeability and provided around an outer periphery of the permeable portion. By absorbing air toward a first surface of the permeable portion, the workpiece is attached and attracted to a second surface of the permeable portion opposite to the first surface. The retaining device further includes a retainer ring provided on an outer peripheral portion of the plate for preventing an outer edge of the workpiece from being overhung by polishing; and a backup ring located between the plate and the retainer ring for putting the retainer ring into pressure contact with the polishing pad. Since the workpiece can be attached and attracted to or released from the plate by a simple operation, the time required for retaining the plate is shortened. Further, the damage to other machines and equipment used for workpiece retaining which is caused by the polishing liquid is alleviated, and thus the maintenance of such machines and equipment becomes easier. Moreover, the flatness of the polished workpiece is improved.

9 Claims, 2 Drawing Sheets

WORKPIECE RETAINING DEVICE AND METHOD FOR PRODUCING THE SAME

BACKGROUND OF THE INVENTION

1. Field of the Invention

The present invention relates to a device for retaining a workpiece to be polished, the surface of which needs to be polished to be precisely and uniformly flat, such as a semiconductor wafer, an interlevel layer and a metal wire used in a semiconductor device, a memory disc, and a glass plate used in an LCD; and a method for producing the same.

2. Description of the Related Art

Conventionally, a semiconductor wafer, an interlevel layer and a metal wire used in a semiconductor device, a memory disc, a glass plate used in an LCD, and the like are polished to be precisely and uniformly flat in the following manner.

A workpiece to be polished as mentioned above is secured to a rotatable retaining plate in one of the conventional methods (1) through (3) described below. An artificial leather-like polishing cloth is attached to a rotating board located opposed to the retaining plate. A polishing liquid containing polishing grains is supplied between the polishing cloth and the workpiece while the polishing cloth and the workpiece are caused to slide with respect to each other.

(1) Wax mounting method: A metal or ceramic retaining plate is coated with wax melted by heat and then cooled down to a softening point of the wax, thereby securing the workpiece to the retaining plate.

(2) Vacuum chuck method: Suction openings having a diameter of 0.5 mm to several millimeters are formed in a metal or ceramic retaining plate by machining, and the workpiece is attracted to the retaining plate by a vacuum pump which absorbs air through the suction openings from near the rear and side surfaces of the retaining plate. Thus, the workpiece is secured to the retaining plate.

(3) No-wax mounting method: A retaining plate is provided with an artificial leather-like polymer foam material. The polymer foam material is moistened to obtain water in pores thereof. When water comes out of the pores by a pressure applied to the material through the workpiece, a negative pressure is generated in the pores. By the combination of the negative pressure and the surface tension of the water, the workpiece is secured to the retaining plate.

The above-mentioned three methods each have the following problems associated therewith.

(1) Wax mounting method (a) After the workpiece is polished, the wax used for securing the workpiece remains on the rear surface of the retaining plate, which must be removed by troublesome washing steps.

(b) The workpiece cannot be heated to a temperature higher than the softening point of the wax.

(c) Gel or foreign substances such as dust, if contained in the wax, are transferred to the surface of the workpiece, thereby forming dimples in the workpiece during the surface polishing operation, which lowers the quality of the polished workpiece.

(2) Vacuum chuck method (a) The workpiece is attracted and thus partially deflected toward the suction openings while the workpiece is being polished. When the polishing is finished, the workpiece recovers to its original state, and as a result the area which is recovered from the deflection state is not satisfactorily polished.

(b) The polishing liquid is pulled into the tube of the vacuum pump between the workpiece and the retaining plate and then through the suction opening, which causes malfunctions in and corrosion of the vacuum pump.

(3) No-wax mounting method

Due to the flexibility of the polymer foam material, it is difficult to transfer the flatness of the rigid metal or ceramic retaining plate to the surface of the workpiece by the principle of so-called profiling machining.

Further, all the above-mentioned conventional methods have the problem in that, while the workpiece slides against the polishing cloth, stress is concentrated along an outer periphery of the workpiece, causing an overhanging lip along the outer peripheral edge thereof to spoil the flatness.

SUMMARY OF THE INVENTION

According to one aspect of the present invention, a device for retaining a workpiece to allow the workpiece to slide against a polishing pad located on a polishing board opposed to the device includes a plate including a permeable portion through which air is absorbed toward a first surface thereof for attaching and attracting the workpiece to a second surface thereof opposite to the first surface, and a less permeable portion having a lower permeability than the permeable portion and provided around an outer periphery of the permeable portion; a retainer ring provided on an outer peripheral portion of the plate for preventing an outer edge of the workpiece from being overhung by polishing; and a backup ring located between the plate and the retainer ring for putting the retainer ring into pressure contact with the polishing pad.

In one embodiment of the invention, the less-permeable factor is provided for preventing a polishing liquid from penetrating into the outer peripheral portion and a part of the first surface which is not to be in contact with the workpiece.

In one embodiment of the invention, the retainer ring is formed of a friction-resistant synthetic resin and a surface of the retainer ring is treated so as to be smooth.

In one embodiment of the invention, the less permeable factor has a projecting portion, and the retaining ring and the backup ring are located on the projecting portion.

In one embodiment of the invention, the backup ring is formed of a material which is deformable in a thickness direction thereof at a ratio of about 0.1% to about 20% by a pressure of about 50 to about 1,000 g/cm$^2$.

In one embodiment of the invention, the device further includes a rigid insert ring between the retainer ring and the backup ring for positioning a surface of the retainer ring to be in contact with the polishing pad at substantially an identical level with a surface of the workpiece to be in contact with the polishing pad.

In one embodiment of the invention, the plate is formed of a ceramic porous material obtained by bonding ceramic grains together with an inorganic binder.

In one embodiment of the invention, the ceramic grains each have a diameter of about 0.1 mm and the inorganic binder contains silica.

According to another aspect of the present invention, a method for producing a device for retaining a workpiece to allow the workpiece to slide against a polishing pad located on a polishing board opposed to the device includes the steps of injecting a resin into an outer peripheral portion of a permeable plate to form a seal portion having a lower permeability than the rest of the plate; cutting off a part of the seal portion to form a projecting portion; and attaching an elastically deformable backup ring and a retainer ring on the projecting portion.

A retaining device according to the present invention includes an air and liquid permeable ceramic plate including a plurality of continuous pores. A workpiece to be polished is put on a surface of the plate and is attracted to the plate by absorbing air from the other side of the plate through the pores in the plate by a vacuum system such as a vacuum pump. A polishing liquid supplied between the workpiece and a polishing pad, which is provided to slide against the workpiece, does not penetrate into a part of the plate which is not put into direct contact with the workpiece, because the pores in such a part are sealed. The pores are provided in a sufficiently large quantity, have a sufficiently small and uniform diameter, and are distributed uniformly. Accordingly, the workpiece is not locally deflected as is when being attracted by the conventional vacuum chuck method.

The retainer ring is close to the workpiece, and a surface of the retainer ring is at substantially the same level with a surface of the workpiece. By such a structure, the stress caused during the polishing operation is concentrated along an outer peripheral edge of the retainer ring, which avoids stress concentration along an outer edge of the workpiece. Thus, the undesirable overhanging lip is not caused, improving the flatness of the workpiece.

In a structure including the elastic backup ring between the plate and the retainer ring, the retainer ring is elastically supported by the backup ring. When the thickness of the workpiece is reduced by polishing, the backup ring is compressed, thereby keeping the retainer ring at substantially the same level as the surface of the workpiece.

In the case where the workpiece has a significantly greater thickness than a workpiece for which the retaining device is designed, a rigid insert ring can be provided between the retainer ring and the backup ring. By providing an insert ring having an appropriate thickness, the surface of the retainer ring can be kept at substantially the same level with the surface of the workpiece.

In such a structure, the workpiece can be attached and attracted to or released from the plate simply by turning on or off the vacuum pump. The time required for attaching and retaining the workpiece properly is shortened. Further, the reduction in the degree of vacuum of the vacuum system and the damage to the vacuum system which are caused by penetration of the polishing liquid are alleviated. Accordingly, the vacuum system can be more easily maintained. Due to the improved uniform flatness of the retainer ring and the plate formed of ceramic beads, the flatness of the workpiece is significantly improved. In detail, the flatness of a unit area, the flatness of an outer edge area, and the flatness of the entire area of the workpiece are all significantly improved.

Thus, the invention described herein makes possible the advantages of (1) providing a retaining device which can attach and attract or release a workpiece by a simple operation in a shorter period of time and a method for producing the same; (2) providing a retaining device which alleviates damage, caused by the polishing liquid, to other machines and equipment used for workpiece retaining, thereby making the maintenance thereof easier and a method for producing the same; and (3) providing a retaining device for improving the flatness of the workpiece and a method for producing the same.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

A structure of a retaining device 8 for retaining a workpiece 7 to be polished in an example according to the present invention will be described with reference to FIGS. 1 and 2. The workpiece ? is, for example, a semiconductor wafer such as a silicon wafer or an SOI wafer; a semiconductor film oxidized by heat; an interlevel layer or a metal wire used in a semiconductor device; a memory disc; or a glass plate used in an LCD.

Figure 1:
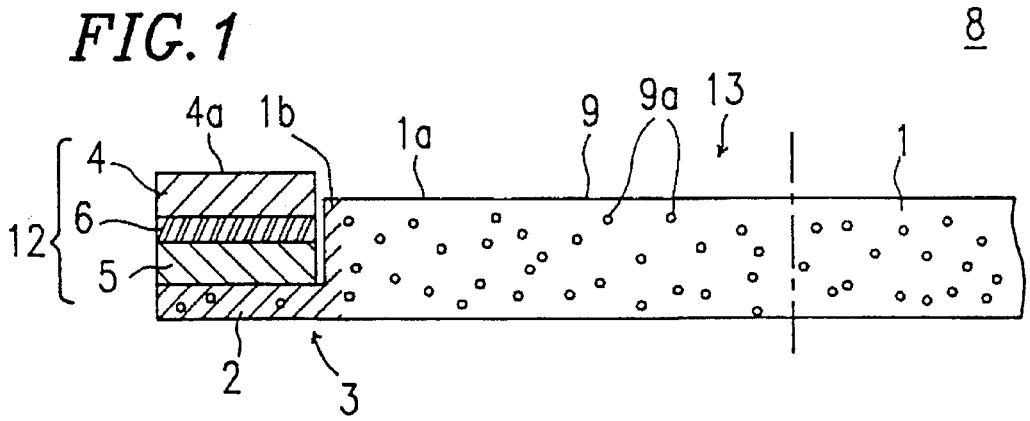
FIG. 1 is a partial cross sectional view of a retaining device in an example according to the present invention.

As is shown in FIG. 1, the retaining device 8 includes a permeable plate 9. The plate 9, which is generally disc-shaped, has a central portion 1 having a top surface la and a ring-shaped projecting portion 2 preferably projected from a bottom part of the central portion 1. The plate 9 includes a plurality of continuous pores 9*a* (for example, 200 pores/$cm^2$) which have small and uniform sizes (for example, 1 mm in diameter) and are distributed uniformly. The ring-shaped projecting portion 2 and an outer peripheral portion 1*b* of the central portion 1 act together as a less permeable portion 3.

On the ring-shaped projecting portion 2, an assembly 12 including a retainer ring 4, a sheet-like insert ring 6 and a backup ring 5 may be provided. A space 13 surrounded by the assembly 12 accommodates the workpiece 7 as is shown in FIG. 2. The retainer ring 4, the backup ring 5, and the insert ring 6 are preferably all machined to be aligned with respect to the outer periphery and the inner periphery thereof.

Figure 2:
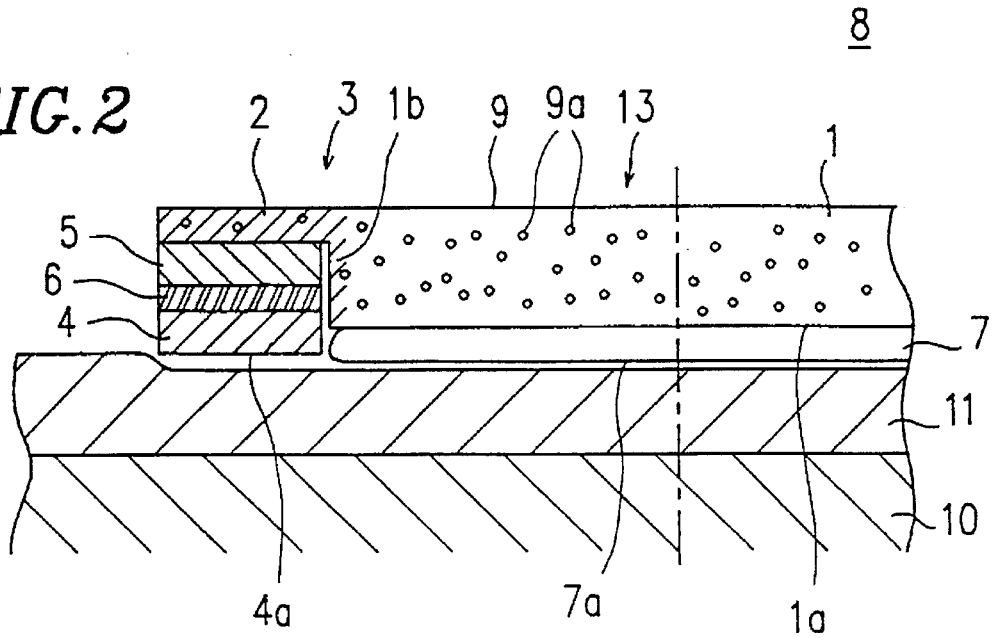
FIG. 2 is a partial cross sectional view of the retaining device shown in FIG. 1 in the state of being used with a polishing board.

The retaining device 8 is used as is shown in FIG. 2.

The retaining device 8 is located opposed to a polishing pad 11 located on a polishing board 10. A surface 4*a* of the retainer ring 4 is in pressure contact with a surface of the polishing pad 11 with a uniform pressure over the entire area thereof. The workpiece 7 is put on the surface la of the central portion 1. By absorbing air upward through the pores 9*a* in the central portion 1 using a vacuum pump or the like, the workpiece 7 is attracted to the central portion 1 of the plate 9. While a polishing liquid is being supplied between the workpiece 7 and the polishing pad 11, the workpiece 7 and the polishing pad 11 move, for example, slidably in rotation with respect to each other, thereby polishing a surface 7a of the workpiece 7. The assembly 12 has a sufficient height to position the surface 4*a* at the same level with the surface 7*a*.

Figure 3:
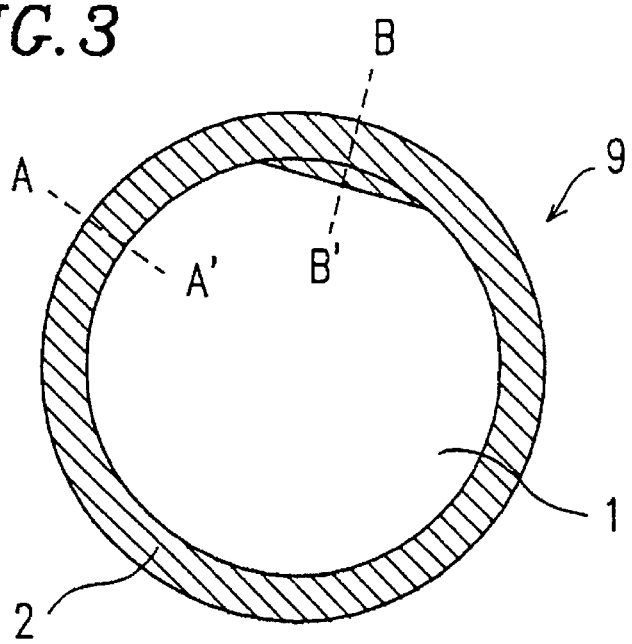
FIG. 3 is a plan view of a plate used in a retaining device in an example according to the present invention.
Figure 4A:
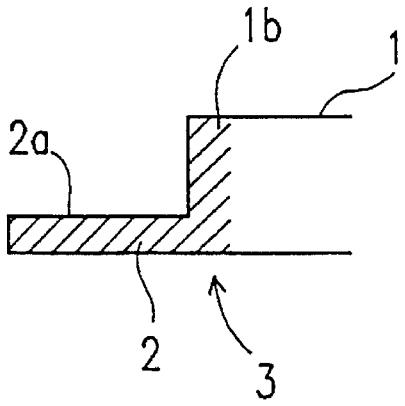
FIG. 4A is a cross sectional view of the plate shown in FIG. 3 along line A–A'.
Figure 4B:
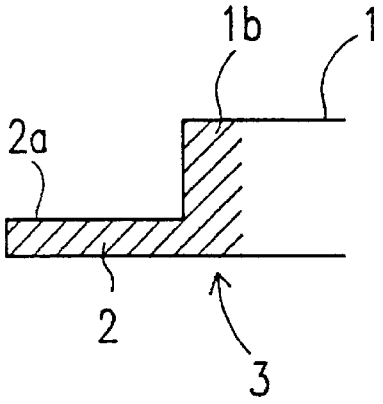
FIG. 4B is a cross sectional view of the plate shown in FIG. 3 along line B–B'.

FIG. 3 is a top view of the plate 9, and FIGS. 4A and 4B are cross sectional views thereof, respectively taken along lines A–A' and B–B' in FIG. 3. As is appreciated from FIGS. 3, 4A and 4B, the less permeable portion 3 has a greater width along line B–B' than the rest of the area in compliance with the shape of the workpiece 7, which has an orientation flat portion.

The plate 9 can be formed of any material which is rigid and has continuous pores; for example, metal, hard synthetic resin or glass. Preferably, the plate 9 is formed of ceramic. In detail, ceramic powders are sintered to form ceramic grains (also referred to as "ceramic beads"), and the ceramic grains are bonded together by an inorganic binder. For example, alumina powders are sintered to form beads each having a diameter of approximately 0.1 mm, and such beads are combined by a silica-type inorganic binder. The plate 9 formed in this manner is porous. Preferably, the plate 9 has a minimum possible resistance against air and liquid permeation. A preferable resistance is 400 mmHg.

The less permeable portion 3 may be formed by injecting a liquid resin into the pores 9*a* of the projecting portion 2 and the outer peripheral portion 1*b* of the central portion 1 of the plate 9 and then solidifying the resin. The less permeable portion 3 formed in this manner has a permeability significantly lower than that of the rest of the plate 9 or of substantially zero. The seal portion 3 is preferably formed in the above-described portions so as not to be directly related to the retaining operation of the workpiece ? realized through the continuous pores 9*a*.

The retaining device 8 may be produced in the following manner.

First, a disc-shaped porous plate is prepared. An area of a top surface thereof which is to be in contact with the workpiece 7 is masked by a masking tape. A liquid resin is injected into the plate from the top surface to form a less permeable portion.

Preferable liquid resins are, for example, a solution of thermoplastic polymer, thermoplastic emulsion, a melt of thermoplastic polymer, and a mixture of a liquid thermosetting resin and a curing agent therefor. A material having an excessively low level of viscosity goes below the masking tape, and a material having an excessively high level of viscosity does not sufficiently penetrate into the pores 9*a*. Accordingly, a mixture of a liquid thermosetting resin and a curing agent therefor which has a viscosity in the range of 1,000 to 1 million poise and does not generate gas when being cured is preferable. Such preferable resins include, for example, an epoxy resin, polyurethane, polyester, a fluoride resin, polyolefin, polyoxymethylene, and polyamide. Especially, a mixture of a thermosetting resin and a curing agent therefor is preferable. As a curing agent, any curing agent which is generally used for curing a thermosetting resin can be used.

After the liquid resin in the less permeable portion is solidified, the masking tape is removed. A top outer peripheral portion of the porous plate is cut off in a ring shape, thereby obtaining the plate 9 having the central portion 1 and the ring-shaped projecting portion 2. The liquid resin can be injected into the plate 9 after the top outer peripheral portion is cut off.

Next, the backup ring 5, the insert ring 6, and the retainer ring 4 are attached on the projecting portion 2 by an adhesive or the like. Thus, the retaining device 8 is completed.

The retainer ring 4 is formed of a material having a low relative coefficient of friction. The relative coefficient of friction is determined by the material of a polishing board 10 or a polishing pad 11 with which the retainer ring 4 is put into contact.

Preferable materials for the retainer ring 4 include a fluoride resin, polyolefin, polyoxymethylene, and polyimide. The retainer ring 4 formed of such a material is treated with surface smoothing by, for example, polishing.

The backup ring 5 is preferably formed of a material which causes elastic deformation of about 0.1 to about 20% when being compressed by a pressure of about 50 to about 1,000 g/cm$^2$, which is generally used in polishing. More preferably, the material is deformable at about 1 to about 10% with respect to a pressure of about 100 to about 500 g/cm$^2$. The backup ring 5 needs to be easily compressed or expanded so that, when the thickness of the workpiece 7 is reduced by polishing, the thickness thereof is changed accordingly to keep the surface 4*a* of the retainer ring 4 at substantially the same level as the surface 7*a* of the workpiece 7. However, the backup ring 5 also needs to be resistant against expansion in the horizontal direction even if being compressed in the vertical direction. Preferable materials include a thermoplastic elastomer such as polyurethane, a thermosetting elastomer, and various rubber materials. Especially, a foam material formed of an elastomer or rubber material is preferable.

Insert rings 6 having various thicknesses can be provided in order to deal with workpieces of various thicknesses. When the thickness of one workpiece is greatly different from the thickness of another workpiece, the insert ring 6 in use is replaced with another insert ring 6 having a different thickness, to realize an appropriate thickness of the assembly 12. A preferable material for the insert rings 6 is rigid and can be formed into various thicknesses by, for example, polishing. Preferable materials include epoxy resins, polyesters and polyimides both filled with glass fiber.

The retainer ring 4 can be chamfered or rounded at an outer edge to be contact with the polishing pad 11. The inner diameter of the assembly 12 is equal to or slightly greater than the outer diameter of the workpiece 7.

The assembly 12 of the retainer ring 4, the insert ring 6 and the backup ring 5 can be attached to a surface 2*a* of the projecting portion 2 by an adhesive such as a two-sided adhesive sheet.

EXAMPLE

Hereinafter, the retaining device 8 will be described in a practical example.

A. Production

Step 1:

A plate having a thickness of about 20 mm and a diameter of about 50 mm formed of alumina beads each having a diameter of about 0.1 mm, Beads Chuck (registered trademark) produced by Kyocera Corp. was prepared. A masking tape having an adhesive on one side thereof was applied to a central portion of a surface of the plate. The masking tape was formed of a polyester film which was patterned in correspondence with a silicon wafer having a diameter of 200 mm.

Step 2:

An epoxy resin containing a curing agent mixed therein in a prescribed amount was prepared. The epoxy resin has a viscosity of 3000 cps/25° C. (measured by a B-type rotary viscosity meter). The epoxy resin was caused to flow from the top surface of the plate and left for about 3 minutes to allow the resin to penetrate into the plate. Then, excessive epoxy resin was removed from the surface by a squeeze roll.

Step 3:

The resultant plate was placed upside down on a flat board having a releasability and kept in an oven at a temperature of 120° C. for 60 minutes, thereby curing the epoxy resin.

Step 4:

After the epoxy resin in the plate was completely cured, the plate was taken off from the flat board, and the masking tape was removed.

Step 5:

Burrs of the epoxy resin on the top surface of the plate were removed. A part of the plate was cut in a ring shape. In detail, the plate was cut to a depth of mm from the top surface and by 25 mm from the outer peripheral edge toward the center thereof. The resultant plate 9 had a central portion 1 and a portion projecting from the central portion (projecting portion 2).

Step 6:

A retainer ring 4 having an inner diameter of about 200 mm, an outer diameter of about 250 mm, and a thickness of about 5 mm was formed of an acetal resin.

A pressure-sensitive two-sided adhesive tape was applied to a surface of the retainer ring opposite to the surface 4*a*. A backup ring 5 having the same inner and outer diameter as those of the retainer ring 4 and a thickness of about 10 mm was formed of a silicon rubber sponge. A pressure-sensitive two-sided adhesive tape was applied to a surface of the backup ring 5. An insert ring 6 having the same inner and outer diameter as those of the retainer ring 4 and the backup ring 5 and a thickness of about 650 μm was formed of an epoxy resin filled with glass fiber. A pressure-sensitive two-sided adhesive tape was applied to a surface of the insert ring 6.

Step 7:

On the top surface 2*a* of the projecting portion 2 of the plate 9, the backup ring 5, the insert ring 6 and the retainer ring 4 were stacked in this order after peeling off releasable paper on the two-sided adhesive tapes. The three rings were adhered to each other and to the projecting portion 2 of the plate 9. Thus, the retaining device 8 was completed.

B. Evaluation (Evaluation 1)

The resultant retaining device 8 was mounted on a polishing machine having a vacuum absorption mechanism (for example, LPG-2000 produced by Lapmaster Corp.), and an eight-inch bare wafer was located on the surface 1*a* of the central portion 1. The wafer was polished under the conditions shown below in the state of being attracted to the central portion 1 by the vacuum absorption mechanism.

The polished wafer showed satisfactory characteristics such as TTV (total thickness variation) of 0.3 μm and a STIR (site total indicator reading) of a 15 mm×15 mm square site of 0.2 μm. TTV is the difference between the maximum thickness and the minimum thickness of a part of the wafer which needs to be flat.

Wafer used: 8-inch wafer formed of single crystalline silicon P(100)

First polishing

Polishing cloth: SUBA800 (SUBA:registered trademark) produced by Rodel Nitta Company Polishing slurry: NALC02350 produced by Nalco Chemical Company 20-fold dilution Pressure: 300 g/cm$^2$ Amount of slurry: 1000 ml/min.

Time: 15 minutes

Second polishing

Polishing cloth: MHS35A produced by Rodel Nitta Company

Polishing slurry: LS10 produced by Rodel Inc. 13-fold dilution

Pressure: 150 g/cm$^2$

Amount of slurry: 500 ml/min.

Time: 5 minutes

Third polishing

Polishing cloth: UR100 produced by Rodel Inc.

Polishing slurry: LS11 produced by Rodel Inc. 13-fold dilution

Pressure: 100 g/cm$^2$

Amount of slurry: 500 ml/min.

Time: 5 minutes (Evaluation 2)

The resultant retaining device 8 was mounted on the polishing machine LPG-2000, and an eight-inch semiconductor wafer including a circuit and covered with an oxide film was located on the surface la. The wafer was polished under the conditions shown below in the state of being attracted to the central portion 1 by the vacuum absorption mechanism.

The polished wafer showed satisfactory characteristics; namely, the fluctuation ratio in the thickness of the oxide film (non-uniformity) with respect to the thickness of the oxide film (50 nm) was 2%, and the planarity of the circuit with respect to the substrate was 5 nm.

Wafer used: 8-inch silicon wafer with an oxide film

Polishing cloth: IC1000 produced by Rodel Inc.

Polishing slurry: ILD1300 produced by Rodel Inc.

Pressure: 500 g/cm$^2$

Amount of slurry: 500 ml/min.

Time: 3 minutes (Evaluation 3)

The resultant retaining device 8 was mounted on the polishing machine LPG-2000, and an eight-inch SOI wafer is located on the surface 1*a*. The SOI wafer was obtained by bonding two mirror surface silicon wafers together and polishing one of the wafer to have a thickness of about several micrometers. The wafer was polished under the conditions shown below in the state of being attracted to the central portion 1 by the vacuum absorption mechanism.

The polished wafer showed satisfactory characteristics; namely, the fluctuation ratio in the thickness of the thicker wafer with respect to the thickness (1 μm) of the thinner wafer was 5%.

Wafer used: 8-inch SOI wafer

First polishing

Polishing cloth: MHS35A produced by Rodel Nitta Company

Polishing slurry: RODEL2398 produced by Rodel Inc. 20-fold dilution

Pressure: 250 g/cm$^2$

Amount of slurry: 500 ml/min.

Time: 15 minutes

Second polishing

Polishing cloth: UR100 produced by Rodel Inc.

Polishing slurry: LS11 produced by Rodel Inc. 13-fold dilution

Pressure: 100 g/cm$^2$

Amount of slurry: 500 ml/min.

Time: 5 minutes (Comparative example 1)

Using the conventional wax mounting method, a wafer was polished in the following manner.

An eight-inch bare wafer was bonded on a ceramic board of the polishing machine LPG-2000 using wax. The wafer was polished under the same conditions as used in evaluation 1. The flatness of the resultant wafer, represented by TTV of 0.8 μm and STIR of 0.6 μm, was about the same as that of wafers marketed today.

(Comparative example 2)

Using the conventional no-wax mounting method, a wafer was polished in the following manner.

A template produced by Rodel Nitta Company was mounted on a ceramic board of the polishing machine LPG2000, and an eight-inch bare wafer is mounted to the template wetted by pure water. The wafer was polished under the same conditions as used in evaluation 1. The flatness of the resultant wafer, represented by TTV of 1.1 μm and STIR of 0.9 μm, was about the same as that of wafers marketed today.

As is appreciated from the above-described results, a wafer polished by a retaining device according to the present invention has a more uniform flatness with less local variations than the wafers polished by any of the conventional methods both in terms of TTV and STIR.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A device for retaining a workplace to allow the work piece to slide against a polishing pad located on a polishing board opposed to the device, the device comprising:

a plate including a permeable portion through which air is absorbed toward a first surface thereof for attaching and attracting the work piece to a second surface thereof opposite to the first surface, and a less permeable portion having a lower permeability than the permeable portion and provided around an outer periphery of the permeable portion;

a retainer ring provided on an outer peripheral portion of the plate for preventing an outer edge of the work piece from being overhung by polishing; and a backup ring located between the plate and the retainer ring for putting the retainer ring into pressure contact with the polishing pad.

2. A device according to claim 1, wherein the less permeable portion is provided for preventing a polishing liquid from penetrating into the outer peripheral portion and a part of the first surface which is not to be in contact with the workpiece.

3. A device according to claim 1, wherein the retainer ring is formed of a friction-resistant synthetic resin and a surface of the retainer ring is treated so as to be smooth.

4. A device according to claim 1, wherein the less permeable portion has a projecting portion, and the retaining ring and the backup ring are located on the projecting portion.

5. A device according to claim 1, wherein the backup ring is formed of a material which is deformable in a thickness direction thereof at a ratio of about 0.1% to about 20% by a pressure of about 50 to about 1,000 g/cm$^2$.

6. A device according to claim 1, wherein further comprising a rigid insert ring between the retainer ring and the backup ring for positioning a surface of the retainer ring to be in contact with the polishing pad at substantially an identical level with a surface of the workpiece to be in contact with the polishing pad.

7. A device according to claim 1, wherein the plate is formed of a ceramic porous material obtained by bonding ceramic grains together with an inorganic binder.

8. A device according to claim 7, wherein the ceramic grains each have a diameter of about 0.1 mm and the inorganic binder contains silica.

9. A device according to claim 1, wherein the less permeable portion is formed by injecting a liquid resin into pores of the plate and solidifying the liquid resin.

* * * * *